United States Patent [19]

Hodge

[11] 4,026,461

[45] May 31, 1977

[54] NEWSPAPER SUPPORT INSERT

[76] Inventor: Joel W. Hodge, 208 Riverview Court, Elizabethton, Tenn. 37643

[22] Filed: June 29, 1976

[21] Appl. No.: 700,918

[52] U.S. Cl. ..... 232/17; 232/1 C
[51] Int. Cl.² ..... B65D 91/00
[58] Field of Search ..... 232/1 C, 17

[56] References Cited

UNITED STATES PATENTS

| | | | |
|---|---|---|---|
| 2,120,857 | 6/1938 | Crawford et al. | 232/1 C |
| 2,156,858 | 5/1939 | Landis | 232/17 |
| 2,414,613 | 1/1947 | Ruetsch | 232/17 |
| 2,807,409 | 9/1957 | Gieseler | 232/1 C |
| 2,845,217 | 7/1958 | Jaques | 232/17 X |
| 3,042,293 | 7/1962 | Miller | 232/1 C |
| 3,275,228 | 9/1966 | Golla | 232/1 C |

*Primary Examiner*—James T. McCall
*Assistant Examiner*—Peter A. Aschenbrenner
*Attorney, Agent, or Firm*—Donald R. Cassady; R. Laddie Taylor

[57] ABSTRACT

A newspaper support is provided which comprises a horizontally corrugated wedge of about one-half the length of a newspaper delivery tube and at least one-half the interior width thereof. The support possesses a reversely turned forward clamp portion to engage the lower front edge of the tube and at least one drainage hole at each trough of the corrugated surface.

5 Claims, 3 Drawing Figures

NEWSPAPER SUPPORT INSERT

BACKGROUND OF THE INVENTION

Delivery of newspapers in rural and suburban areas by motor carrier is customary in many parts of the country. In these areas a receptacle is provided for the receipt of the paper. This receptacle generally consists of a metal or plastic tube of one piece construction open on one end and closed on the other. The tube is usually slightly tapered away from the open end.

Such receptacles often become wet inside and at the bottom of the tube due to rain beating on the open end thereof, or merely by ingress interiorly through longitudinal bottom openings customarily provided, or through apertures through which fasteners are projected.

Ridges are sometimes molded into the bottom of the tube to raise the paper therefrom and to provide additional longitudinal stability and strength. Such a modification in structure is provided for in U.S. Pat. No. 3,134,538, and U.S. Pat. No. 3,181,782.

These ridges have not been completely successful in keeping a paper dry and others have invented and devised methods and devices to comparmentalize the tube to keep the paper at or near the top of the tube. Miller, in U.S. Pat. No. 3,042,293, has provided a spring clip which holds the paper between the clip and the inside top of the tube. This particular device is quite effective in keeping the paper dry, but suffers from the disadvantage that the delivery person must always force the paper into the tube instead of flipping the paper into the tube from an automobile window, thus slowing delivery and limiting the size of the route. A preferrable device would allow the delivery person to use the box in a normal inconstricted manner.

SUMMARY OF THE INVENTION

It is an object of this invention to provide a device which will protect the newspaper from water lying on the bottom of the tube.

It is a further object of this invention to provide a newspaper protecting support which will allow the delivery tube to be used in a normal manner as unconsticted at the open end.

It is still further an object of this invention to provide a device that can be installed in delivery tubes aready in use as well as in new tubes during manufacture sale or installation.

This invention provides a corrugated metal wedge which rises from the base of the tube at the open end to about one-half the height of the tube at about the longitudinal mid-point of the tube. The wedge is attachable to the tube by a clip formed from a reverse turn of the front edge of the wedge. The wedge is of a width at least equal to one-half the width of the tube and preferrably of a width to fit snugly into the tube. The corrugated surface of the wedge contains at least one drainage hole at the groove of each corrugation. The corrugations are preferrably horizontal with respect to the slope of the wedge.

In a preferred embodiment, the device has a support leg attached to the upper edge of the wedge extending substantially to the inside base surface of the tube when a paper is placed in the tube.

During use, a paper deposited in the tube will rest on the top crown of the wedge and on the inside base surface of the tube at the closed rear of the tube. In this position the portion of the paper near the open end of the tube is raised to the top of the tube well protected from the weather.

DETAILED DESCRIPTION OF THE DRAWINGS

In order to more clearly disclose the construction, operation, and use of the invention, reference should be made to the accompanying drawings forming part of the disclosure. Throughout the drawings like reference characters designate the same part.

Figure 1:
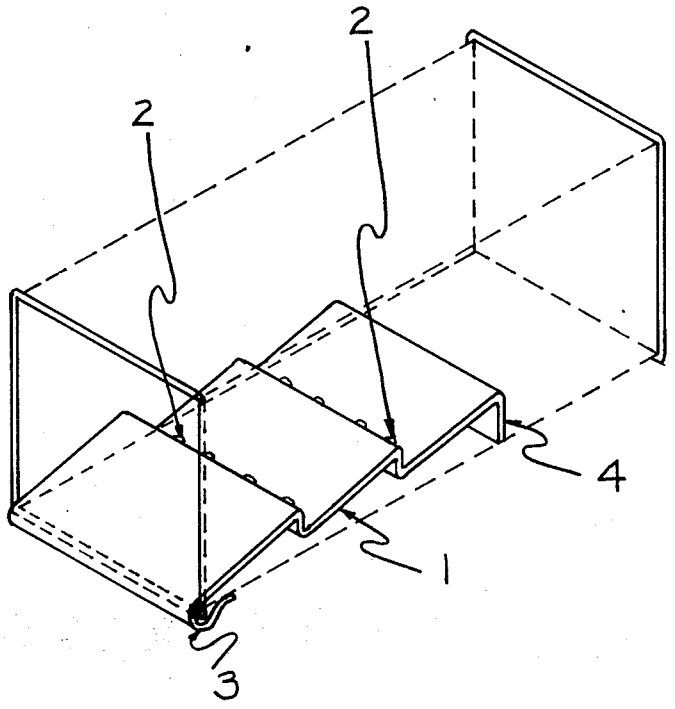
FIG. 1 shows a view of the device of this invention when installed in a newspaper delivery tube.
Figure 2:
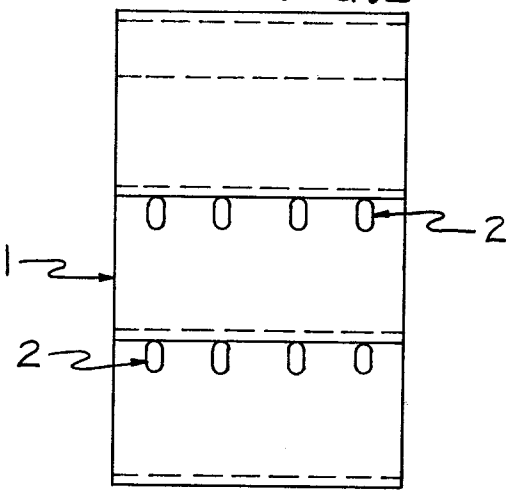
FIG. 2 shows the device of this invention from a vertical view.
Figure 3:
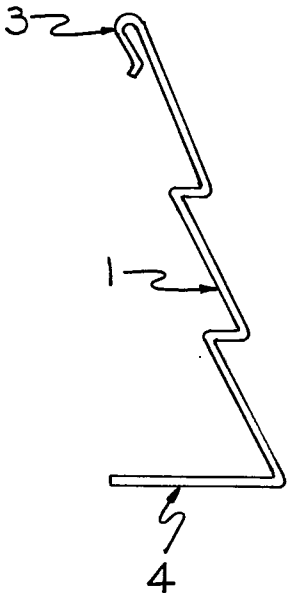
FIG. 3 shows the device of this invention from a horizontal view.

In the drawings corrugated surface 1 is shown with drainage holes 2 at the base of each of the horizontal grooves of the surface. The corrugations as shown, horizontal to the elevation of the wedge are not meant to limit the scope of the invention as particularly pointed out in the appended claims, they are merely indicative of the preferred embodiment of the invention. The wedge surface is attached to the tube by means of a reverse curve clip 3 formed from the front edge of the corrugated surface of the wedge.

In the preferred embodiment shown, the wedge surface is supported by leg 4 formed from the rear surface of the corrugated wedge.

I claim:

1. A readily insertable newspaper support for insertion into a newspaper delivery tube of one piece, elongated, hollow body construction open at one end and closed at the other; which support comprises a corrugated wedge surface of about one-half the length of the tube having a reversely turned forward clamp means to engage the lower surface of the open end of the tube and at least one drainage hole at each trough of the corrugated surface.

2. The support of claim 1 wherein the upper edge of the corrugated surface is about one-half the inside height of the tube.

3. The support of claim 1 wherein the support terminates at the upper end with a support leg which extends to the surface of the inside base of the tube.

4. The support of claim 1 wherein the corrugated surface of the support extends at least one-half the inside width of the tube.

5. The support of claim 4 wherein the support is of a width to fit snugly into the newspaper delivery tube.

* * * * *